US006671888B2

(12) United States Patent
Wallace

(10) Patent No.: US 6,671,888 B2
(45) Date of Patent: Jan. 6, 2004

(54) BELT SYSTEM

(76) Inventor: Scot Wallace, 5929 Lords Ave., Sarasota, FL (US) 34231

( * ) Notice: Subject to any disclaimer, the term of this patent is extended or adjusted under 35 U.S.C. 154(b) by 129 days.

(21) Appl. No.: 10/113,166

(22) Filed: Apr. 1, 2002

(65) Prior Publication Data

US 2003/0182715 A1 Oct. 2, 2003

(51) Int. Cl.[7] ..... A41D 1/06
(52) U.S. Cl. ..... 2/237
(58) Field of Search ..... 2/338, 235, 236, 2/237, 336, 219, 220, 221, 311, 79, 227, 321, 300, 76, 141.1, 234; 24/31 R, 32, 33 A; 128/99.1, 100.1, 101.1, 102.1

(56) References Cited

U.S. PATENT DOCUMENTS 1,607,156 A 11/1926 Godshaw
1,662,074 A 3/1928 McMeans
2,923,009 A 2/1960 Cookman
4,580,298 A * 4/1986 Tuisl ..... 2/237
4,999,853 A 3/1991 Tanner
5,500,959 A 3/1996 Yewer
5,566,397 A 10/1996 Scott
5,575,011 A * 11/1996 Allen ..... 2/227
6,085,356 A * 7/2000 Redmond, Sr. ..... 2/237

* cited by examiner

*Primary Examiner*—Tejash Patel
(74) *Attorney, Agent, or Firm*—Quarles & Brady LLP

(57) ABSTRACT

A multi-segment belt system is provided for use with a pair of conventional pants. There is a docking strap mountable along the waist region by being suspended on two belt loops of the pants, the strap having a contact binding surface on its front side. There is also a cinching strap having a slot adjacent one end, a grip ring at an opposite end, a contact binding surface on one side suitable to mate with the contact binding surface of the docking strap, and a contact binding surface on an opposite side. A loop element allows a portion of the cinching strap to slide there through, and is connected along an inside surface of a waist band of the pants. There is also a closure member having a button on one side and a contact binding surface on an opposite side.

6 Claims, 4 Drawing Sheets

FIG. 1
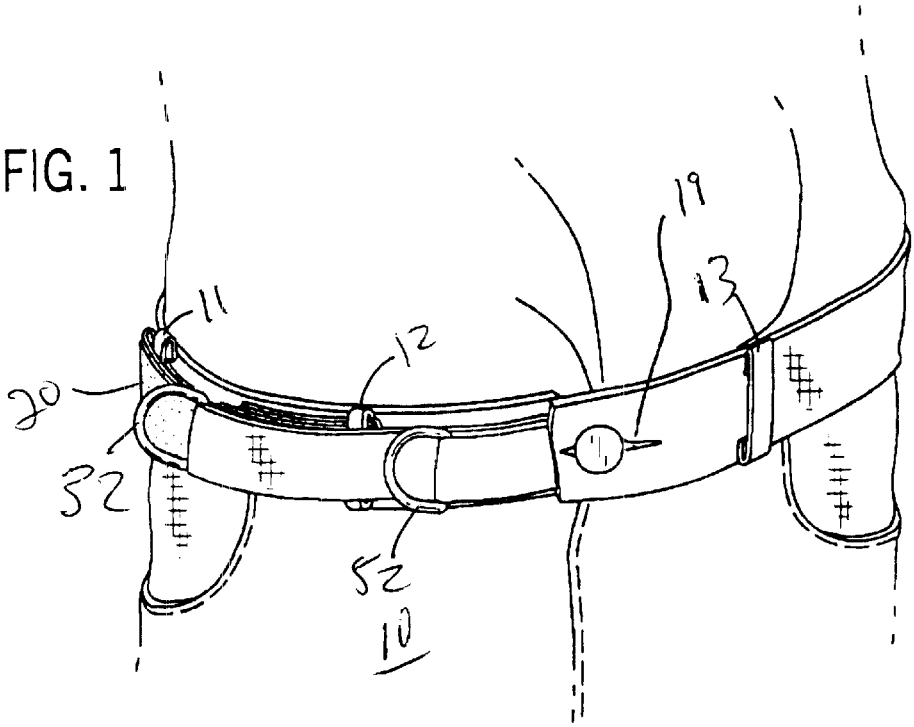
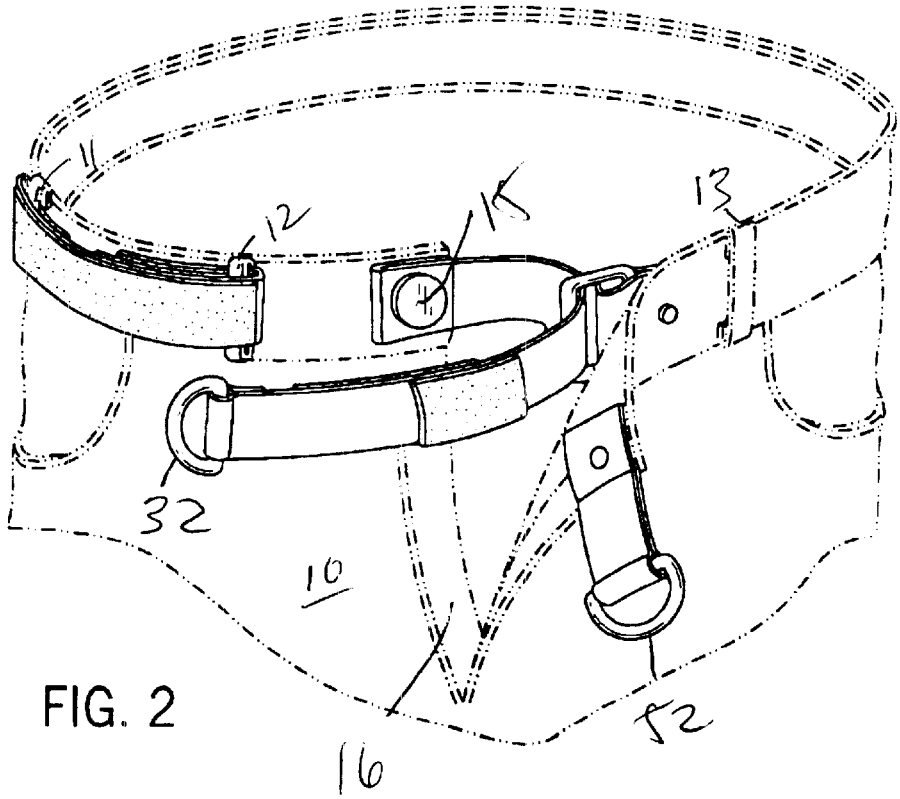
FIG. 2

FIG. 3
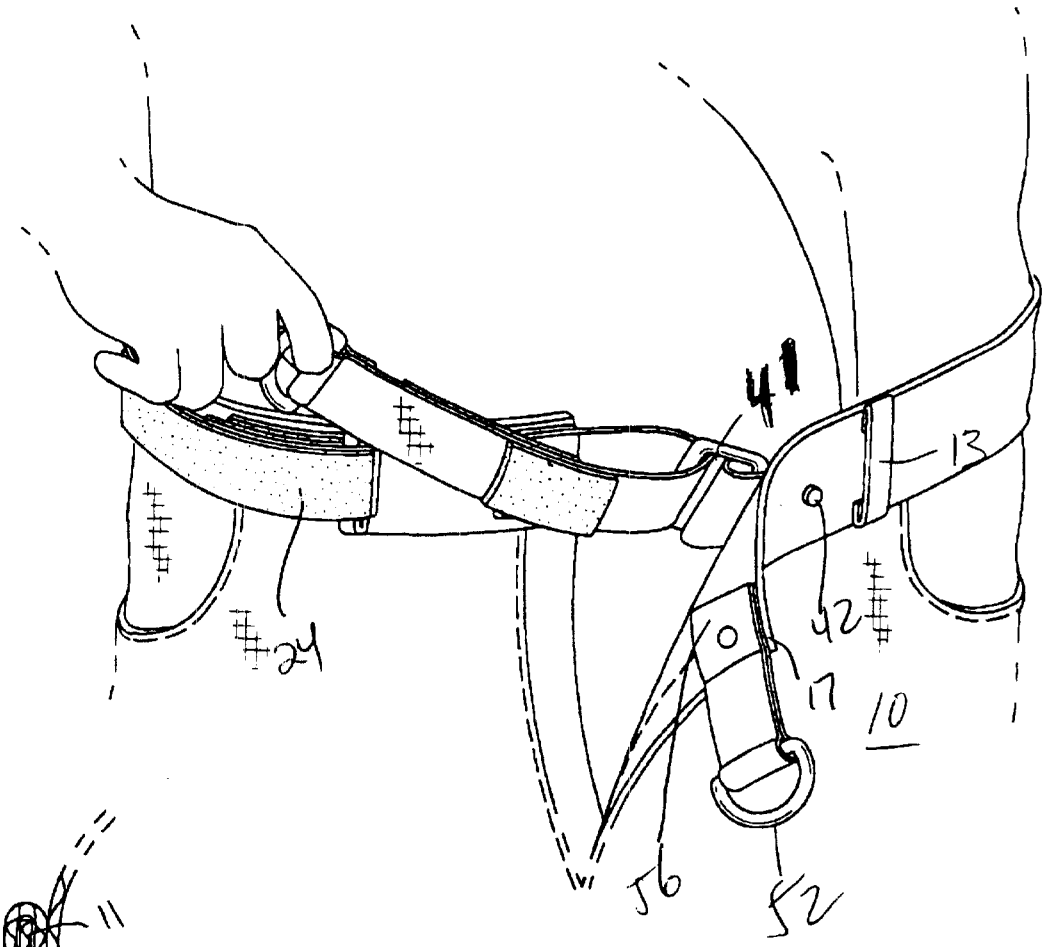
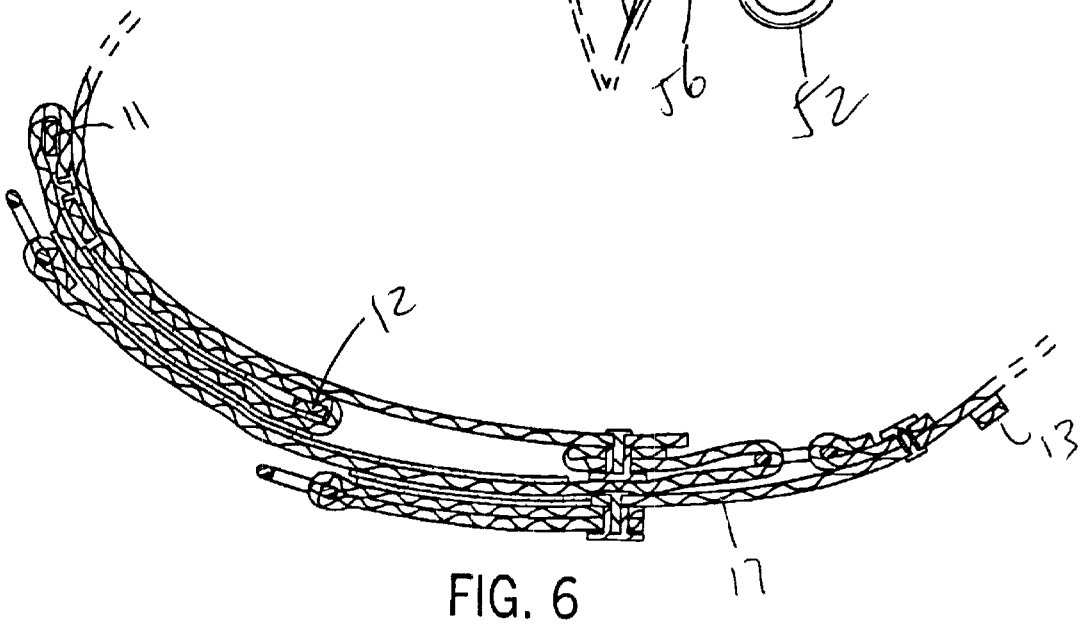
FIG. 6

BELT SYSTEM

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to belts, and in particular to multi-segment belt systems particularly suitable for use by the disabled.

There have been efforts to increase the ability of the disabled (e.g. disabled by virtue of illness, age, or other cause) to take part in the greatest possible range of normal activities, and in particular to do so with the least possible assistance. Some of these efforts have involved governmental regulation such as laws that mandate that public facilities be modified and/or designed to avoid unnecessary physical barriers.

There have also been a variety of efforts by private companies to design products that allow the disabled to be able to more easily participate in every day activities. For example, private companies have introduced scanners that can read print and then sound out the print so that even the blind can effectively read normal printed materials without assistance.

One area of development relates to the clothing that disabled persons wear. Many such persons have great difficulty in dressing and undressing, particularly with respect to putting on conventional trousers. To the extent the person needs to wear conventional looking trousers, this is particularly disruptive of independence because if a disabled person needs to visit a restroom away from their normal residence, they may not be able to re-dress absent taking an aide with them.

To try to avoid this problem many such persons wear relatively loose-fitting garments (e.g. with elastic waistbands that typically appear almost pajama like). This restricts the fashion choices of the disabled person, may call attention to their disability when they wish to simply blend in, and in any event can adversely affect morale.

There have therefore been some attempts to provide a more standardized frontal appearance for trousers that can be used by such disabled persons. See e.g. U.S. Pat. No. 2,923,009. However, this patent required the use of zippers along the sides of the trousers, adding to the cost of the product, and presenting its own problems with respect to those having significant difficulty in manipulating zippers. Perhaps even more importantly, it was a "solution" which required specialized clothes for the disabled, thereby radically restricting their fashion choices.

There have also been developed (for a variety of reasons) various non-standard belts designed for use around the outside of the waist region of pants. See e.g. U.S. Pat. Nos. 1,607,156, 4,999,853, 5,500,959 and 5,566,397. See also U.S. Pat. No. 1,662,074. While some of these systems used cinching principles and/or hook/loop contact binding principles, none adequately addressed the problem of the tendency of front zippers on such pants to bind absent a specific angle of force being provided when the two leafs of the open pants are pulled towards each other.

Thus, it can be seen that a need exists for an improved belt system for use by the disabled, particularly one that facilitates the closure of the zipper.

SUMMARY OF THE INVENTION

The invention provides a belt system for use with a pair of pants having a waist region with external belt loops and a front opening defining two leafs. Such pants typically have a button on the exterior of one leaf and a slot through the other leaf for receiving the button.

The belt system of the present invention has a docking strap mountable along the waist region by being suspended on two of said belt loops, the strap having a contact binding surface on its front side. The system also has a cinching strap having a slot adjacent one end, a grip ring at an opposite end, a contact binding surface on one side suitable to mate with the contact binding surface of the docking strap, and a contact binding surface on an opposite side.

There is also a loop element having a loop suitable to allow a portion of the cinching strap to slide there through. The loop element also has a connection means suitable to link the loop element along an inside surface of a waist band of the pants. Another portion of the system is a closure member having a button on one side suitable to be displayed through the leaf slot of the pants, and a contact binding surface on an opposite side suitable to mate with the contact binding surface on said opposite side of the cinching strap.

In preferred forms the closure member also has a grip ring, and the docking strap has mating snap connectors adjacent one end to loop around one such pant belt loop, and also has contact binding surfaces adjacent an opposite end of the docking strap to adjustably loop around a second such pant belt loop. The contact binding surfaces can be in the preferred form a plurality of hook and/or a plurality of loop structures. The loop element's connection means can be a pin extendable through the waist region of the pants and a pin trap.

In another form the invention provides a combined pair of pants and belt system. The pants have the usual legs depending from a waist region, the waist region having the usual external belt loops and a front opening defining two leafs, one leaf having a button and the other leaf having a slot for receiving the button. In this combined system such pants are combined with a belt system having the following four features.

The first is a docking strap mounted along the exterior of the waist region by being suspended on two of said belt loops, the strap having a contact binding surface on its front side. The second is a cinching strap having a slot adjacent one end, a grip ring at an opposite end, a contact binding surface on one side suitable to mate with the contact binding surface of the docking strap, and a contact binding surface on an opposite side. The third is a loop element having a loop suitable to allow a portion of the cinching strap to slide there through, the element also having a connection means linking the loop element along an inside surface of a waist band of the pants. The fourth is a closure member having a button on one side displayed through the leaf slot of the pants, and a contact binding surface on an opposite side suitable to mate with the contact binding surface on said opposite side of the cinching strap.

It has been surprisingly learned that the mounting of the loop element along the inside of the leaf of the pants opening is critical to the proper alignment of the zipper. This first requires the loop element to be mounted along the inside of the leaf, and then requires an additional structure to close the leaf.

The design of the present invention also has desirable properties and advantages such as permitting it to be used with conventional pants, allowing it to be used regardless of the size of the waist of the pants, and permitting it to be pre-assembled in most respects before the disabled person needs to leave home.

The parts of the belt system are inexpensive to produce, and easy to assemble on a pair of pants without special training. Further, the overall look of the system, once installed and closed, does not provide an immediate visual cue to the public that the person is disabled.

These and other advantages of the invention will be apparent from the detailed description and drawings.

BRIEF DESCRIPTION OF THE DRAWINGS

FIG. 1 is a frontal perspective view of a belt system according to the present invention, shown positioned on a pair of pants and in a closed position;

FIG. 2 is a view similar to FIG. 1, but with the belt system arrayed in an open position;

FIG. 3 is a view similar to FIG. 2, but with the belt system in process of being cinched closed;

FIG. 6 is a horizontal sectional view taken through the belt system and upper pants portion of FIG. 1.

DETAILED DESCRIPTION OF THE PREFERRED EMBODIMENTS

The invention provides a multi-segment belt system, typically for installation on a pair of pants 10 or the like. The pants have the usual exterior belt loops 11, 12 and 13 (and optionally spaced belt loops around the remainder of the waist region). There is also button 15 on the exterior upper corner of one leaf of the opening by the zipper 16 (not shown). Of course, men's and women's pants position the button on opposite sides of the opening and the preferred embodiment shown can be flipped via a mirror image to provide the design for the opposite sex.

The usual zipper typically has a small rectangular pull element. If desired, the present belt system can also be provided with an additional grip ring that can be looped through a hole on the pull element to provide easier gripping of the pull element. Apart from this, the zipper will function in a conventional manner.

Figure 4:
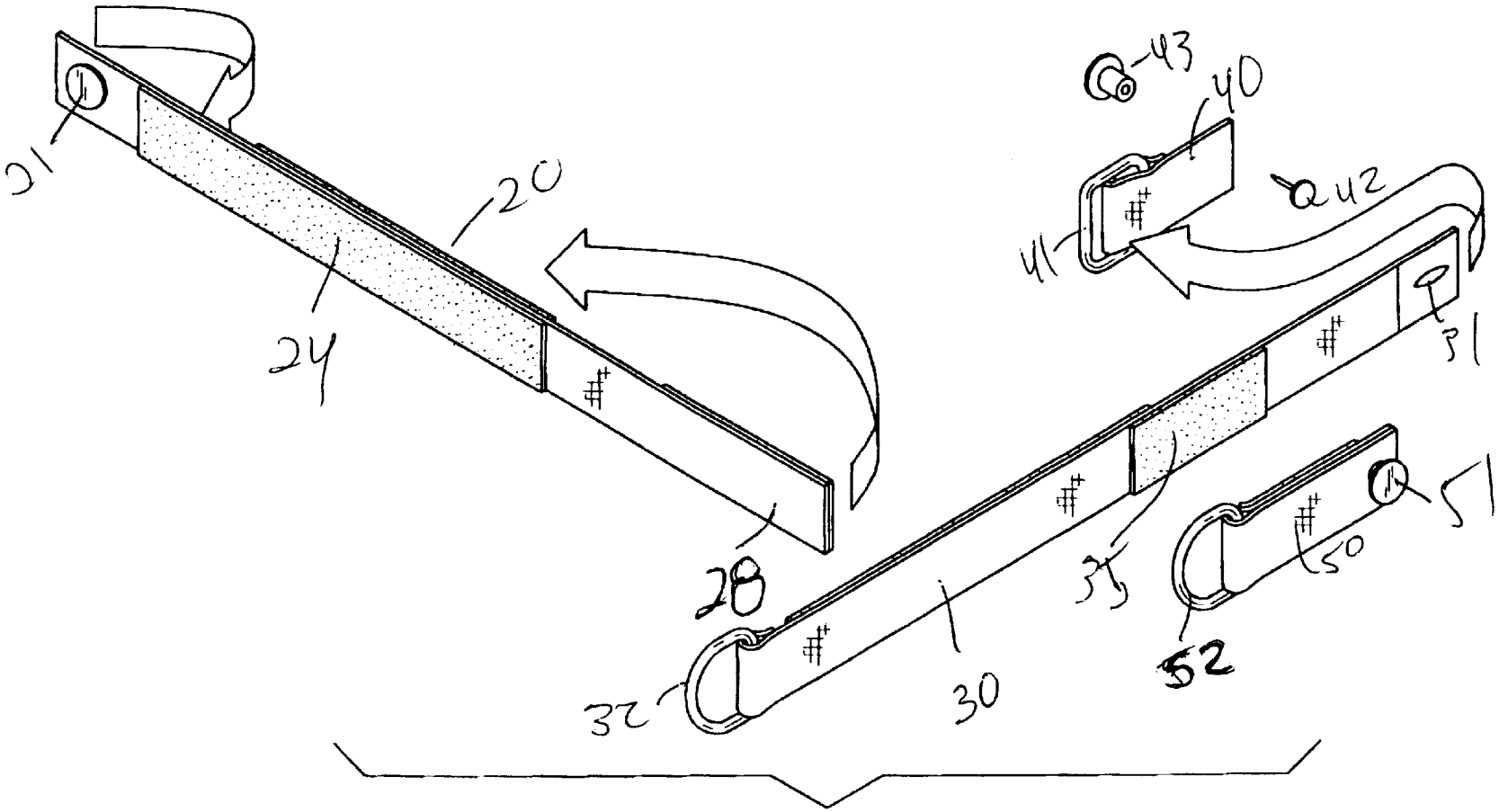
FIG. 4 is an exploded frontal perspective view of the various parts of the belt system of the present invention, apart from the pants on which it is to be installed.
Figure 5:
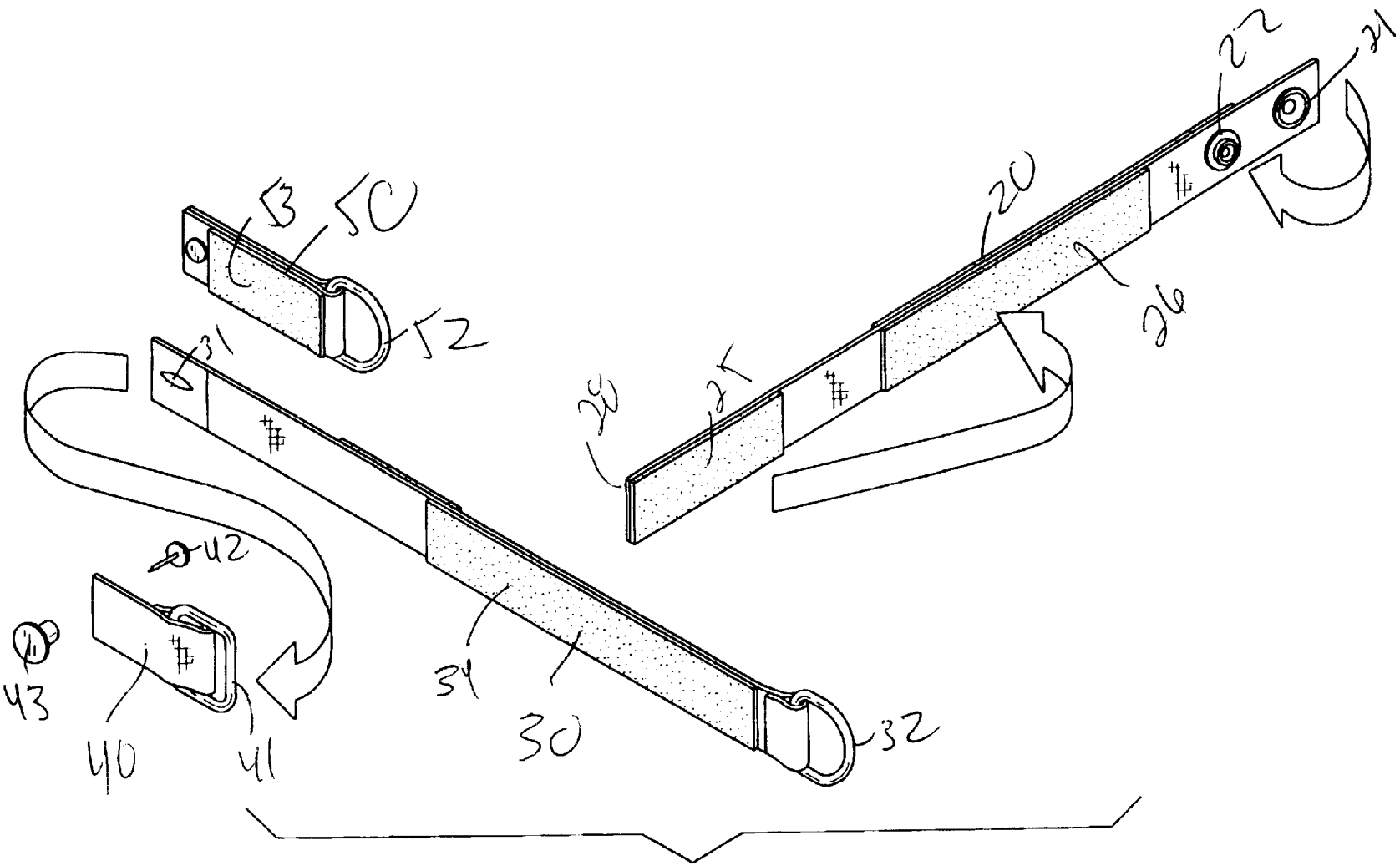
FIG. 5 is an exploded rear perspective view of the FIG. 4 belt system.

Turning now to FIG. 4, the belt system preferably has four main components. The first is a docking/loop strap 20 which has at one end snap members 21 and 22 designed to snap around the belt-loop 11. The loop strap 20 is also provided with Velcro® brand type fastener material 24 (or another contact binding surface) on its front. It also is provided with two such sections 25, 26 of Velcro® which will mate with each other (e.g. one made of loops; the other made of hooks).

It should be recognized that the waist size of various pants varies greatly. As a result, the spacing between belt loops, and the spacing between particular belt loops and the center front of the pants, will vary. Moreover, belt loop positions may be altered from one style to another (even with the same waist size). Nevertheless, the present design can adjust for this.

In this regard, the free end 28 of the strap 20 can be passed in front of the loop 12, then back through the loop 12, and then tugged, and then fixed in place by having Velcro® surface 25 bind to surface 26.

As can be seen from FIG. 3, this will leave an exposed Velcro® attachment surface 24. That surface will be used for purposes described below.

The second main component of the belt system is a cinching or pulling strap 30. It has a through slot 31 at one end and a pull ring 32 at the other. There is a first Velcro® segment 34 on one side of the strap 30 and a second Velcro® segment 35 on the other side of the strap 30.

The third main component/element is an internal strap 40. It has a ring 41 at one end and a two part connector 42/43 at the opposite end. The strap 40 is installed inside the end 17 of the pants 10 by, for example, inserting a pin 42 from the outside of the pants inward, through the strap 40, and into the trapping connector 43.

As shown in FIG. 2, once the straps 20 and 40 are installed in place on pants 10, the end of strap 30 containing the slot 31 can be threaded through the ring 41 and then bent backwards, followed by the pants button 15 being inserted through slot 31. This "traps" the strap 30, while permitting the opening of the pants to be opened significantly so that the pants can be pulled down without disassembling the belt system (e.g. when visiting a lavatory or when changing clothes).

As best shown in FIG. 3, the loop 32 of the strap 30 can then be pulled to cinch the pants closed. Unlike the circumstance in which a cinch strap acts only outside the waist band (compare U.S. Pat. No. 5,500,959) the cinching force here is focused at an angle that prevents the zipper from jamming. Thus, after the cinching it is much easier for a disabled person to pull up the zipper.

The Velcro® segment 34 of strap 30 is selected so as to be suitable to mate with the Velcro® segment 24 of the strap 20 to hold the otherwise loose end of the cinching strap against the clothing (see FIG. 1).

However, there remains two other issues to be addressed.

First, the button 15 which normally would project through the slot 19 is not available to be used for that purpose. More importantly, something is needed to prevent the flap 17 from drooping forward.

Both of these problems are addressed with an element 50 which has a substitute button 51 that can be inserted through slot 19 to present a more conventional final appearance. The strap 50 is also provided with a ring 52 and a Velcro® portion 53 on its inward side.

The Velcro® portion 53 binds to the Velcro® portion 35 of strap 30. This fixes the leaf 17 against drooping forward. The ring 52 facilitates the gripping of this strap 50.

An assistant for the disabled person can pre-assemble the belt system at their convenience (if the disabled person is not able to do so alone). The end result is the assembly shown in FIG. 2. The disabled person can then independently use the belt system.

Once the legs have been inserted into the pants and the main pants body pulled up along the waist and buttocks, the disabled person can position the pants as shown in FIG. 3. The disabled person can then pull on the ring 32 of the cinching strap 30 to align the pants to the closed position. Because of the angle of the cinching force, the zipper of the pants is relatively easy to close, and certainly more resistant to jamming.

The cinching strap can be fixed in place against the strap 20 as shown in FIG. 1. The disabled person can then pull the ring 52 and fix it in place as shown in FIG. 1.

Should the disabled person wish to remove the pants without third party assistance, he or she can easily grip on the two rings 32/52 to break the binding between the Velcro® attachments, and then pull the zipper down. This can easily be achieved even by many people who have severe dexterity disabilities.

The straps can be made of a wide variety of natural or synthetic materials, onto which the Velcro® strips are sewn or otherwise affixed. The rings 32, 41 and 52 are preferably connected to the straps by looping back the straps on themselves, and then sewing the loop closed.

The nature of the connector 42/43 is not critical. For example, an adhesive could be used, or the strap could be otherwise pinned or sewn in place. It is merely important that the connecting means attach some type of loop along the inside of the pants. In this regard, it is not even critical that element 40 have a strap section between the loop and the connecting means, or the loop can be a slot in the strap itself.

With respect to the strap 20, it is not critical how the strap is linked to the belt loops, albeit it is highly preferred that the technique be one that permits adjustment for different spacing of the belt loops.

While Velcro® brand contact binding segments are highly preferred at the positions noted, other hook and loop adherent connection systems (e.g. some of which may have barbed features), and other contact binding systems (e.g. based on adhesive) should also prove suitable. All such systems are referred to herein as contact binding systems.

With respect to strap 50, it is preferable that the strap extend out beyond the leaf 17 of the pants so as to expose a ring 52 to facilitate gripping. However, the rear surface 56 of the portion of that strap behind the leaf 17 can be made of Velcro® and the remainder of the strap not behind the leaf 17 could be eliminated.

Thus, it will be appreciated that the present invention provides a belt system that facilitates the closure of conventional pants by the disabled. The system is relatively inexpensive to produce, can be installed relatively quickly, is adaptable to a wide variety of pants and sizes, and has been shown to be suitable to be exposed to conventional laundering. Also, the resulting assembly provides a significantly less casual appearance than standard elastic band pants do.

Preferred embodiments of the invention have been described in considerable detail. Modifications and variations to the preferred embodiments will be apparent to those skilled in the art, which will be within the spirit and scope of the invention. Therefore, the invention should not be limited to the described embodiments. To ascertain the full scope of the invention, reference should be made to the following claims.

INDUSTRIAL APPLICABILITY

The invention provides an improved belt system particularly suitable for use by those with dexterity disabilities.

I claim:

1. A belt system for use with a pair of pants having a waist region with external belt loops and a front opening defining two leafs, one leaf having a button and the other leaf having a slot for receiving the button, the belt system comprising:

a docking strap mountable along the waist region by being suspended on two of said belt loops, the strap having a contact binding surface on its front side;

a cinching strap having a slot adjacent one end, a grip ring at an opposite end, a contact binding surface on one side suitable to mate with the contact binding surface of the docking strap, and a contact binding surface on an opposite side;

a loop element having a loop suitable to allow a portion of the cinching strap to slide there through, the element also having a connection means suitable to link the loop element along an inside surface of a waist band of the pants; and a closure member having a button on one side suitable to be displayed through the leaf slot of the pants, and a contact binding surface on an opposite side suitable to mate with the contact binding surface on said opposite side of the cinching strap.

2. The belt system of claim 1, wherein the closure member also comprises a grip ring.

3. The belt system of claim 1, wherein the docking strap has mating snap connectors adjacent one end to loop around one such pant belt loop, and also has contact binding surfaces adjacent an opposite end of the docking strap to adjustably loop around a second such pant belt loop.

4. The belt system of claim 1, wherein the contact binding surfaces are either a plurality of hook or a plurality of loop structures.

5. The belt system of claim 1, wherein the loop element's connection means is a pin extendable through the waist region of the pants and a pin trap.

6. A combined pair of pants and belt system, comprising:

a pair of pants comprising legs depending from a waist region, the waist region having external belt loops and a front opening defining two leafs, one leaf having a button and the other leaf having a slot for receiving the button; and a belt system having:

(i) a docking strap mounted along the exterior of the waist region by being suspended on two of said belt loops, the strap having a contact binding surface on its front side;

(ii) a cinching strap having a slot adjacent one end, a grip ring at an opposite end, a contact binding surface on one side suitable to mate with the contact binding surface of the docking strap, and a contact binding surface on an opposite side;

(iii) a loop element having a loop suitable to allow a portion of the cinching strap to slide there through, the element also having a connection means linking the loop element along an inside surface of a waist band of the pants; and (iv) a closure member having a button on one side displayed through the leaf slot of the pants, and a contact binding surface on an opposite side suitable to mate with the contact binding surface on said opposite side of the cinching strap.

* * * * *